US005105855A

United States Patent [19]

Stacher

[11] Patent Number: 5,105,855

[45] Date of Patent: Apr. 21, 1992

[54] APPARATUS AND METHOD FOR CLEARING A WARP YARN BREAK IN A LOOM

[75] Inventor: Angelo Stacher, Arbon, Switzerland

[73] Assignee: Sulzer Brothers Limited, Winterthur, Switzerland

[21] Appl. No.: 611,415

[22] Filed: Nov. 8, 1990

[30] Foreign Application Priority Data

Nov. 10, 1989 [CH] Switzerland ..... 04053/89

[51] Int. Cl.[5] ..... D03J 1/14

[52] U.S. Cl. ..... 139/35; 139/351; 139/353; 28/187

[58] Field of Search ..... 28/187; 139/353, 351, 139/368, 35

[56] References Cited

U.S. PATENT DOCUMENTS

| | | | |
|---|---|---|---|
| 4,233,716 | 11/1980 | Patel | 28/187 |
| 4,791,967 | 12/1988 | Vandeweghe et al. | 139/353 |
| 4,817,675 | 4/1989 | Dewaele et al. | 139/35 |
| 5,046,535 | 9/1991 | Prat | 139/35 |

FOREIGN PATENT DOCUMENTS

| | | |
|---|---|---|
| 0037681 | 10/1981 | European Pat. Off. . |
| 0259915 | 3/1988 | European Pat. Off. . |
| 0318047 | 5/1989 | European Pat. Off. . |
| 2027191 | 2/1980 | United Kingdom . |
| 2216908 | 10/1989 | United Kingdom . |

*Primary Examiner*—Andrew M. Falik
*Attorney, Agent, or Firm*—Kenyon & Kenyon

[57] ABSTRACT

A carriage which is movable into a position over a loom carries a manipulator for drawing a replacement yarn through a reed. A tracing element moves across the width of the warp yarns at a point downstream of the reed to detect a gap in the warp yarns corresponding to the position of a broken yarn. The manipulator moves into alignment with the gap and a guide on the manipulator pivots through the reed to receive an end of the replacement warp yarn. Return pivoting of the guide pulls the replacement warp yarn through the reed and a yarn clamp is activated to faciliatate tieing in of the warp yarn during subsequent operation of the loom.

17 Claims, 7 Drawing Sheets

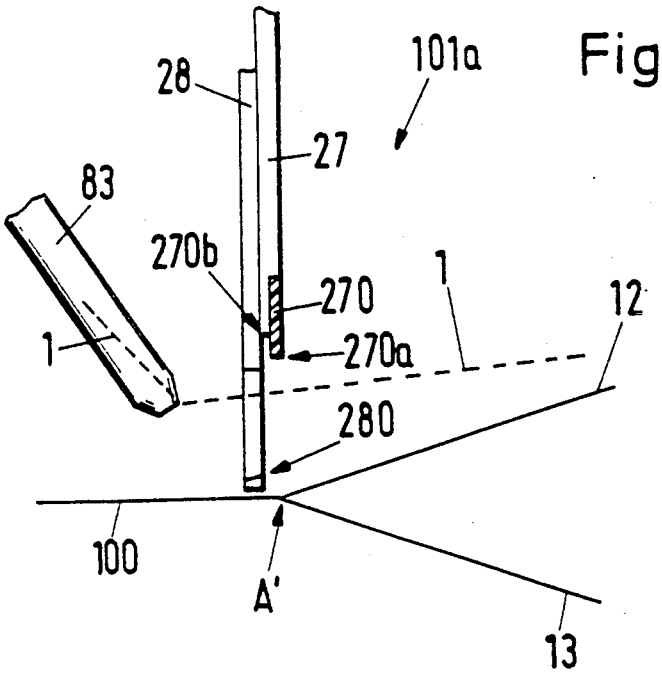
Fig.6a
Fig.6b
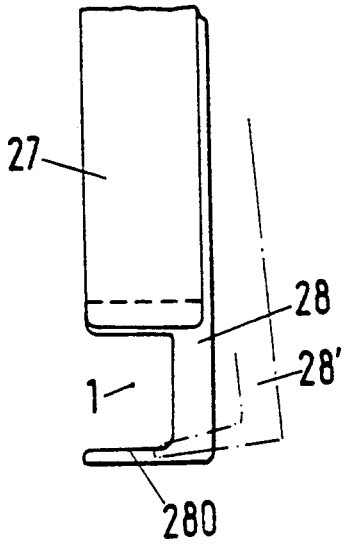
Fig.6c
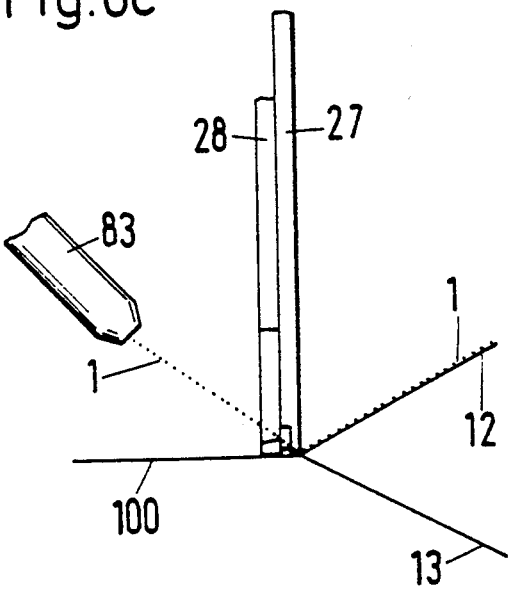
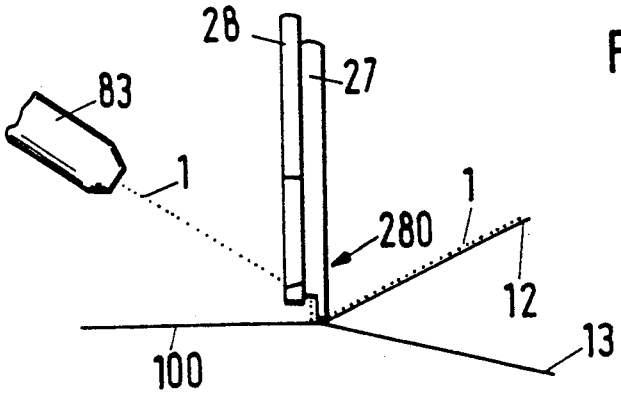
Fig.6d

APPARATUS AND METHOD FOR CLEARING A WARP YARN BREAK IN A LOOM

This invention relates to an apparatus and method for clearing a warp yarn break in a loom and particularly for introducing a replacement warp yarn into a reed of a loom.

Various method and facilities have been known in which a broken warp yarn can be located, engaged, at least to some extent removed and, to some extent, replaced by a replacement or emergency warp yarn which is then drawn in towards a cloth end by suitable draw-in means. For example, European Patent Application 0259915 describes the drawing in of a replacement warp yarn only to a position before a reed.

Accordingly, it is an object of the invention to provide an apparatus and method for drawing a warp yarn into a reed in order to replace a broken warp yarn.

It is another object of the invention to be able to provide an automatic system for clearing a warp yarn break in a complete manner.

Briefly, the invention provides an apparatus and method for clearing a warp yarn break in a loom.

More particularly, the apparatus includes a tracing element for moving across the width of a plurality of warp yarns in the loom and downstream of a reed in order to detect an absence of a warp yarn. This tracing element may include a transmitter for emitting a beam towards the warp yarns and a receiver for receiving a reflected beam from the warp yarns and for emitting a signal in response to reception of a reflected beam in order to indicate the presence of the warp yarn. In addition, the apparatus includes a manipulator for moving across the width of the warp yarns to a position aligned with a detected gap in the warp yarns corresponding to an absent warp yarn. Still further, a guide is pivotally mounted on the manipulator for moving between a first position extending through the reed in order to receive a replacement warp yarn and a second position spaced from the reed in order to draw the replacement warp yarn through the reed and the gap in the shed.

In accordance with the method, the tracing element is moved across the shed of warp yarns in order to detect a gap in the shed corresponding to a broken yarn in the shed. At the same time, the broken warp yarn can be engaged and removed from the shed. Thereafter, a replacement warp yarn is introduced in to the gap in the shed and subsequently drawn through the reed in a position corresponding to the detected gap.

In this respect, the tracing element is moved so as to hunt for the gap in the warp yarns near the reed and, once the gap has been ascertained, the manipulator draws the replacement warp yarn into the reed.

In order to find the position of the replacement warp yarn to be drawn in, the tracing element detects the presence of each warp yarn in a top shed position and emits a corresponding signal in response thereto during movement of the tracing element across the shed. The emitted signals are then compared with a stored empirical sequence of signals. In the absence of any warp yarn and, therefore, in the absence of an expected signal, the instantaneous position of the tracing element relative to the shed is recorded in order to establish the position of a gap in the shed corresponding to a broken yarn. This position becomes the set-value position for the drawing in of the replacement yarn. Thereafter, the guide on the manipulator is moved into alignment with the gap, that is, into the set-value position, and, in such position draws the replacement warp yarn through the reed.

Prior to movement of the tracing element hunts over the warp yarns, a draw-in means on which the tracing element is mounted is initially positioned approximately on the loom by the position of the broken warp yarn, as detected by a warp yarn, monitor being transmitted by the loom to the control of the draw-in means. The draw-in means then takes up the approximate position lengthwise of the loom near to the broken warp yarn. From here, the tracing element hunts for the set-value position.

A drive moves the draw-in means from a normal position stepwise along the reed first in one and then in the other direction, step size increasing continuously with a view to very rapid discovery of the set-value position of the warp yarn to be drawn in.

After the set-value position has been ascertained for the first time in one direction of movement, the set-value position can be ascertained a second time in the opposite direction. A control can determine from the two ascertained set-value positions, a mean set-value position to which the draw-in means is finally moved to draw in the emergency (replacement) warp yarn.

The emergency warp yarn is therefore drawn accurately through the reed to above the cloth without manual intervention so that weaving can be restarted automatically. The ends lying on the cloth of the previously withdrawn broken warp yarn and the ends of the replacement warp yarn are severed either a few weaving cycles after drawing-in or at a subsequent time, for example, during inspection of the cloth.

These and other objects and advantages of the invention will become more apparent from the following detailed description taken in conjunction with the accompanying drawings wherein.

Figure 3:
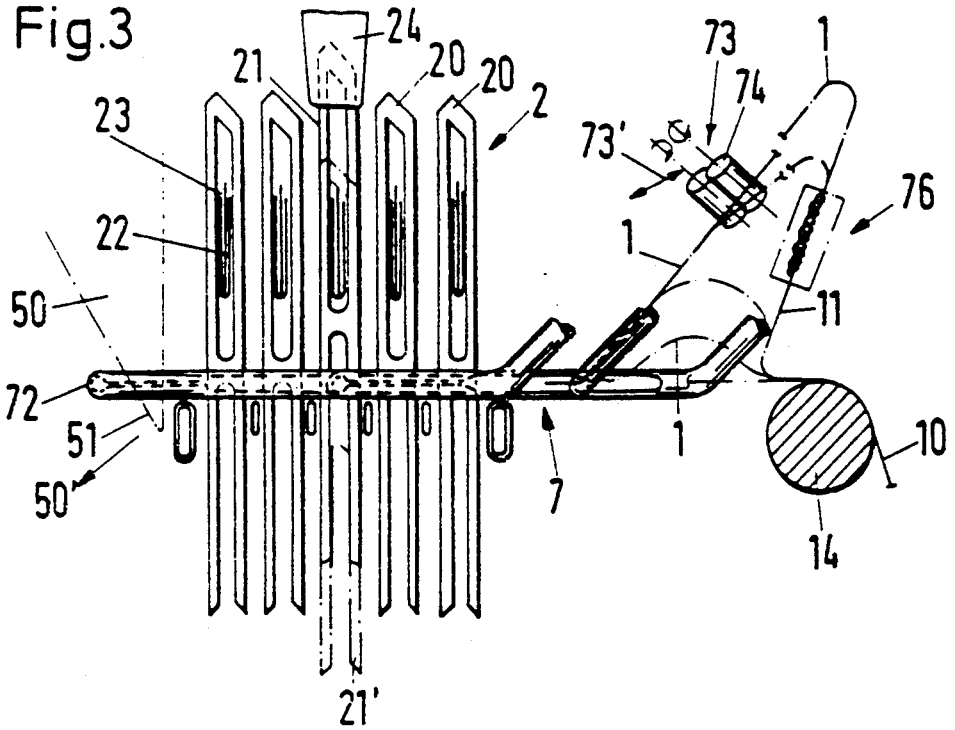
FIG. 3 illustrates a partial view of the weaving region from the whip roll to a warp-yarn stop-motion.
Figure 3A:
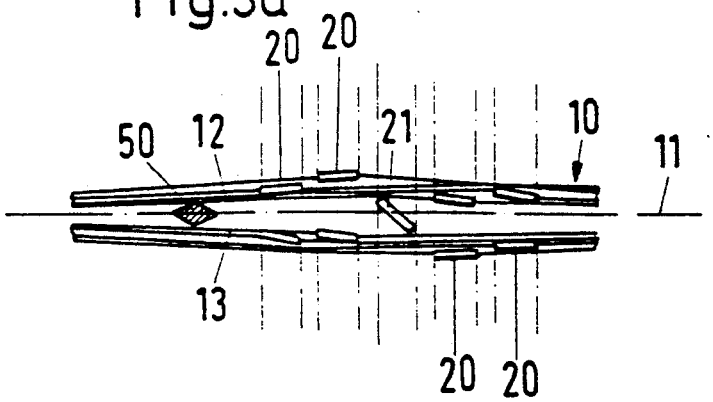
Figure 3B:
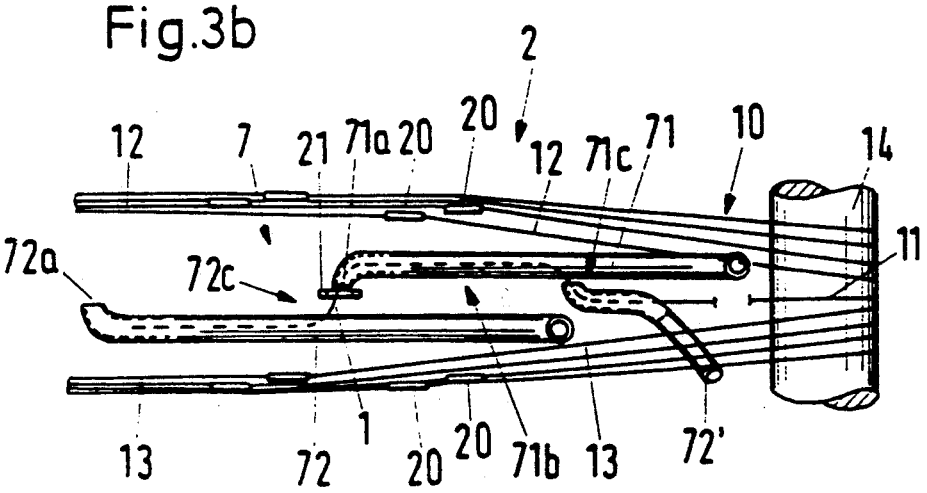
Figure 4:
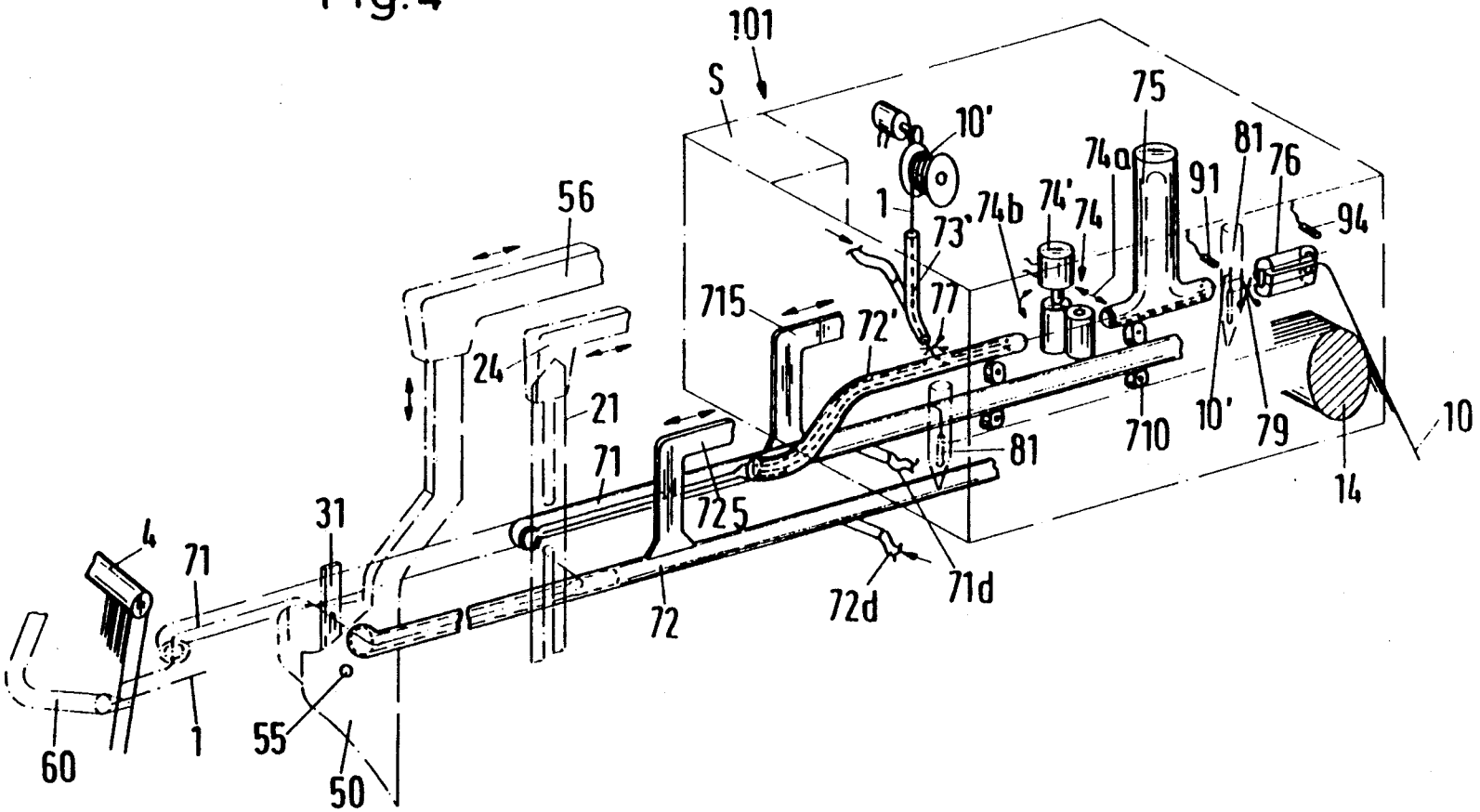

FIG. 3*a* illustrates a partial plan view of the arrangement in FIG. 3;

FIG. 3*b* illustrates a view of the drawing-in tubes during the process of drawing a warp yarn into a wire of the warp-yarn stop-motion;

FIG. 4 diagrammatically illustrates an apparatus for repairing breaks in the warp yarns of a weaving machine in accordance with the invention.

Figure 5A:
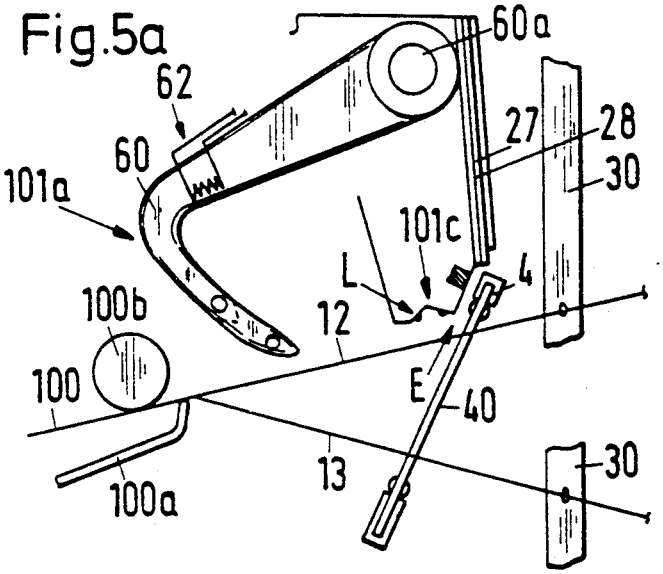
Figure 5B:
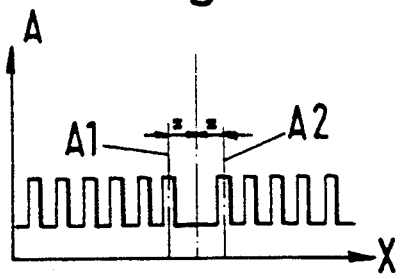
Figure 5C:
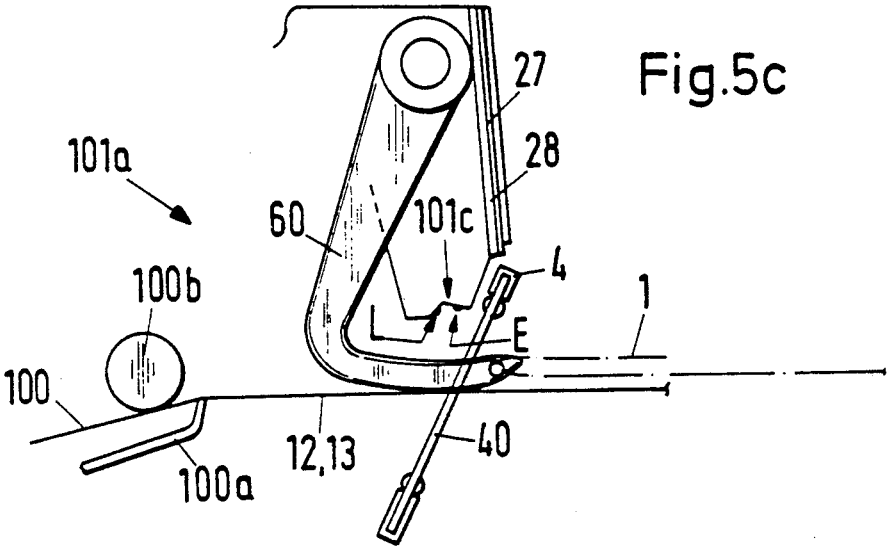
Figure 5D:
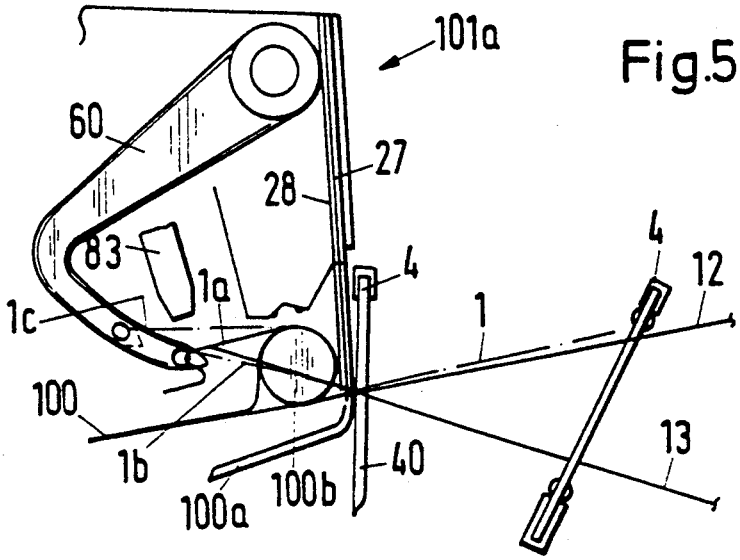
Figure 7A:
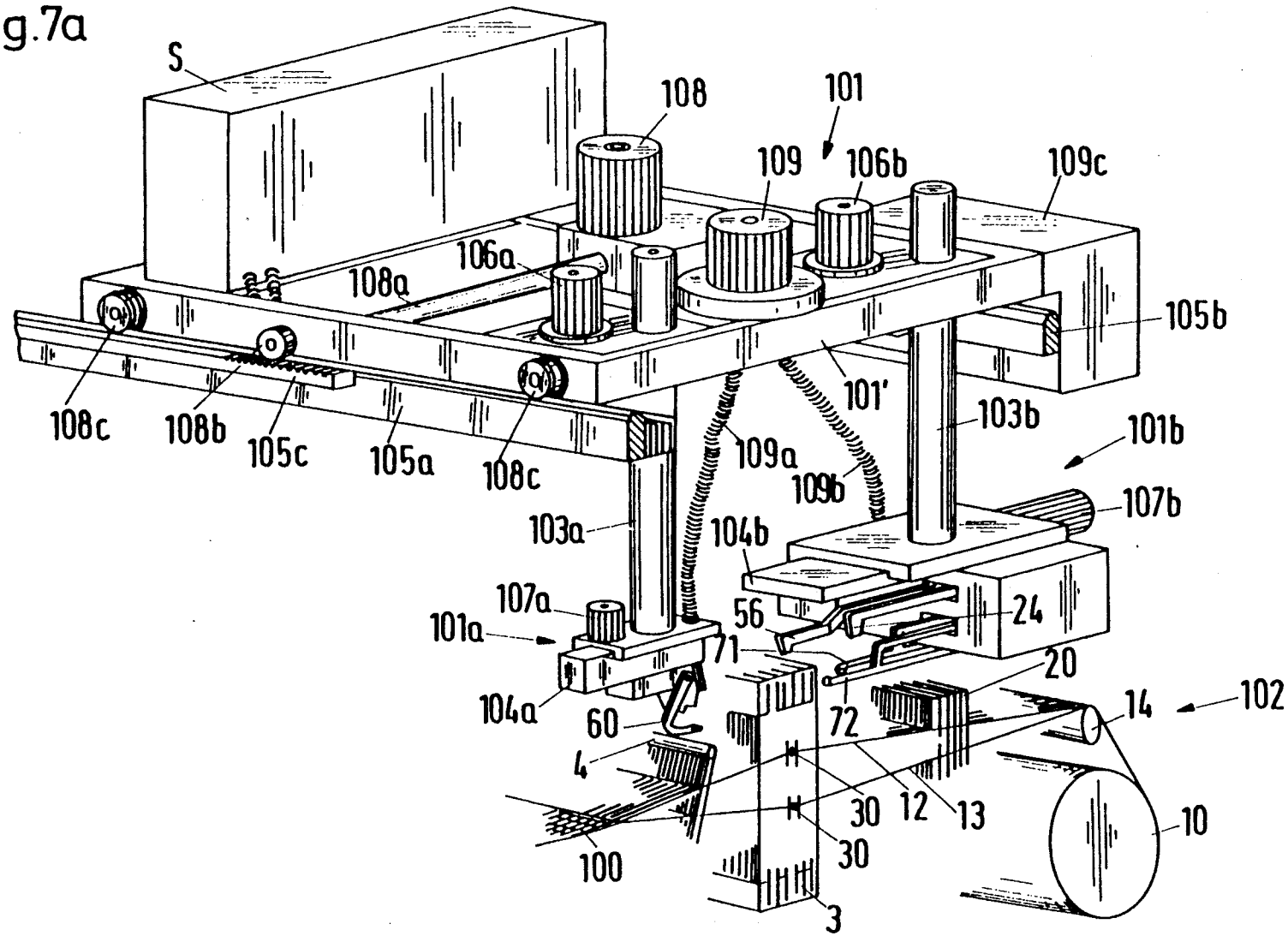
Figure 7B:
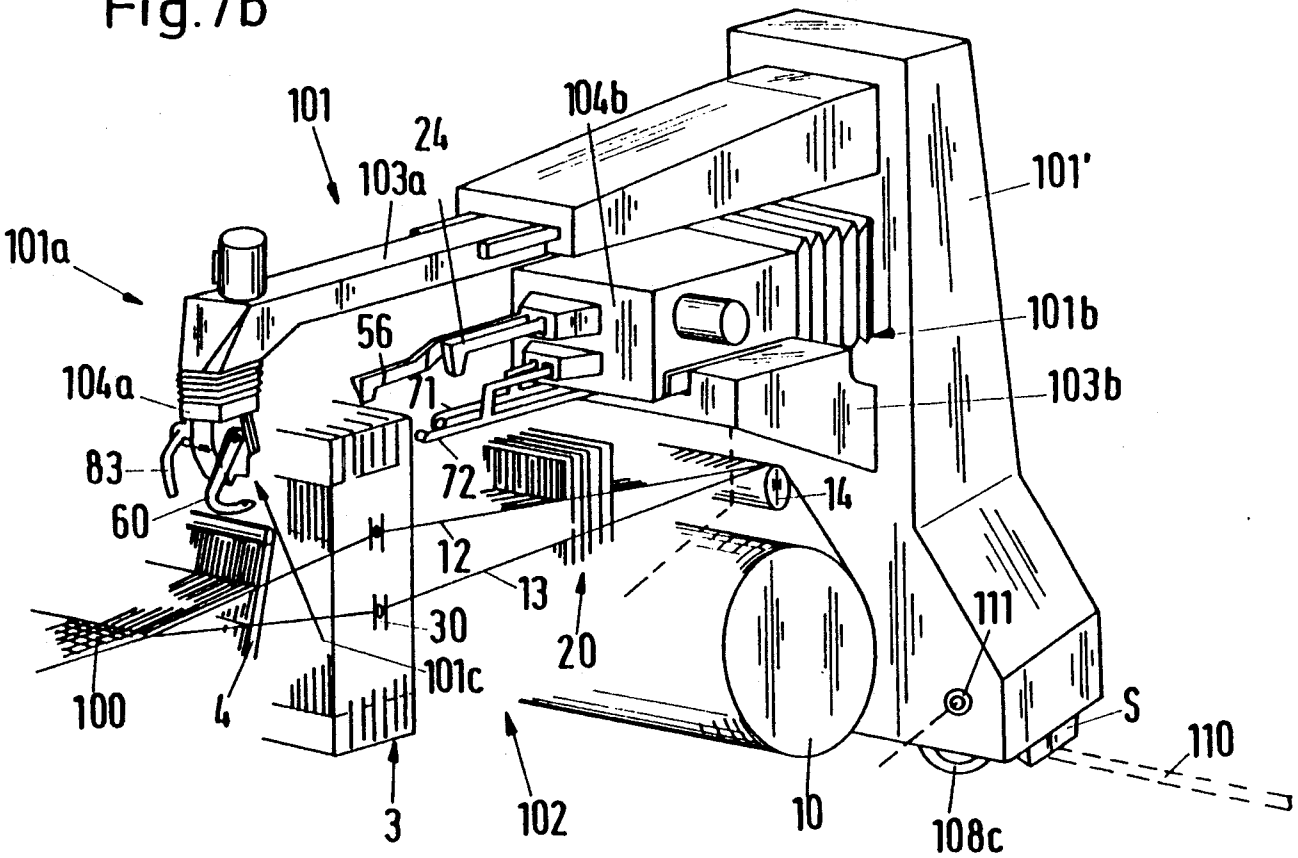

FIG. 5*a* illustrates a side view of a manipulator with a tracing element and guide disposed in an operative position in accordance with the invention;

FIG. 5*b* illustrates a signal sequence emitted by the tracing element and a resulting set-value position for the guide for a drawing-in step;

FIG. 5*c* illustrates the guide in a position passing through a reed for drawing in a yarn;

FIG. 5*d* illustrates a view of the guide after drawing in of a warp yarn;

FIG. 6*a* illustrates a partial side view of a clamp employed in accordance with the invention;

FIG. 6*b* illustrates a side view of a shears blade for severing an inserted yarn;

FIG. 6*c* illustrates the clamp of FIG. 6*a* in a clamping position;

FIG. 6*d* illustrates the shears blade in a cutting position;

FIG. 7*a* illustrates a part perspective view of a carriage for conveying the tracing element and manipulator over a loom in accordance with the invention; and FIG. 7*b* illustrates a modified carriage for mounting of the tracing element and manipulator in accordance with the invention.

Figure 1:
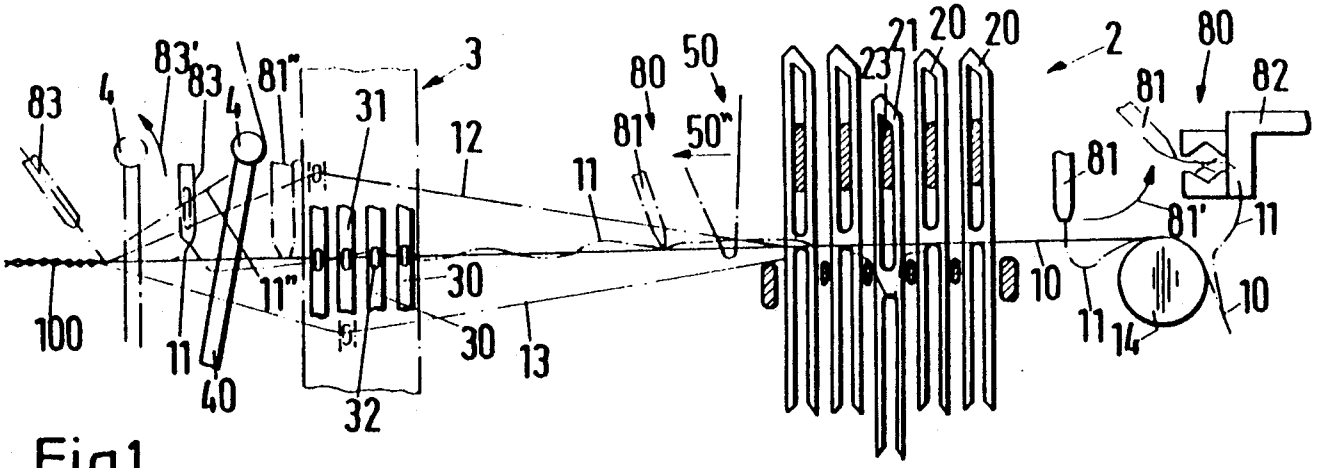
FIG. 1 illustrates a diagrammatic side view of the weaving region of a weaving machine from a whip roll to a woven fabric.

Referring to FIG. 1, a weaving machine is constructed in a conventional fashion for the weaving of a plurality of warp yarns 10 into a cloth 100. As indicated, the warp yarns 10 are passed over a whip roll 14 and directed in a horizontal direction through a warp yarn stop motion 2, a heddle frame 3 and a reed 4.

The warp yarn stop motion 2 has a plurality of wires 20 each of which has an opening for the passage of a warp yarn 10 therethrough. As indicated, one stop motion wire 21 is in a contact position on a contact rail 23 due to the breakage of a warp yarn 11. As illustrated in FIG. 3*a*, the wire 21 and rail 23 may cooperate so that the wire 21 forms a narrow lane in the sheet of warp yarns 10.

The heddle frame 3 is provided with a plurality of heddles for forming a shed with each heddle 30 having an opening 32 for passage of a warp yarn therethrough. As indicated, the heddle 31 has a broken yarn.

The reed 4 is formed of a plurality of guide elements (not shown) for guiding the warp yarns 10 therethrough and for beating a weft yarn in the shed into an apex of the shed to form a cloth with the warp yarns. As schematically illustrated in FIG. 1, a broken warp yarn 11 is assumed to take up a position such that the associated wire 21 of the stop motion has dropped onto the rail 23 while still being guided through the eye 32 of the heddle 31. The adjacent warp yarns 12, 13 are indicated as being in a top shed position and a bottom shed position, respectively. However, these adjacent warp yarns 12, 13 may be in the same shed position.

As indicated in FIG. 1, after a yarn break has been signalled, a device 50 for selecting and isolating the heddle 31 to be re-threaded with a fresh warp yarn is introduced in the lane defined by the broken yarn 11 in order to widen the lane by spreading out the warp yarns to either side. The device 50 is in the form of a folder blade 50 for example as described in U.S. patent application Ser. No. 07/589,076, filed Sept. 27, 1990. Before penetrating into the warp 10, the folder blade 50 is adjusted horizontally in the weft direction of the weaving machine and at the height of the stop motion wires 20 by a suitable drive (not shown). The position of the stop motion wire 21 and, consequently, the desired position of the folder blade 50 can be determined, for example, by a special commercial warp yarn stop motion by determining the resistance of a wire in the weft direction from one side of the stop motion 2 to the place of contact with the wire 21. The position of the stop motion wire can be determined in a simple manner as the resistance per unit length of the resistance wire is known.

Referring to FIG. 4, wherein like reference characters indicate like parts as above, the repair apparatus is mounted on the weaving machine with a pair of elongated drawing-in tubes 71, 72 extending above the plane of the warp yarns. Each tube 71, 72 is carried by an arm 715, 725, respectively and each is guided for longitudinal motion by a plurality of rollers 710 within a housing 101 of the repair apparatus which can be moved in the direction of the weft yarn by suitable means (not shown). The housing 101 also contains a control means S for controlling the various motions of the repair apparatus. The arms 715, 725, rollers 710 and drive (not shown) constitute a means for moving the tubes 71, 72 in parallel to each other for purposes as explained below.

Figure 2:
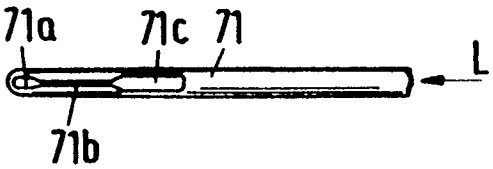
FIG. 2 illustrates a side view of a drawing-in tube.

As illustrated in FIG. 2, one tube 71 is provided with a blowing opening 71*a* from which an end of a fresh yarn can be ejected, a suction opening 71*c* into which a warp yarn can be drawn and a slot 71*b* which extends between the two openings 71*a*, 71*c* to permit movement of a warp yarn laterally out of the tube 71. The other tube 72 is constructed in similar fashion.

Referring to FIG. 2, an air flow L through the tube 71 produces a negative pressure at the suction opening 71*c* and leaves the tube through the blowing opening 71*a*, the flow being deflected at right angles to the longitudinal extent of the tube 71. The fresh warp yarn 1 can be pulled out of the tube 71 through the slot 71*b* at the end of a threading-end process. Suction of the fresh warp yarn 1 into the suction opening 71*c* is assisted in that the blowing opening 72*a* of the other tube 72 is disposed opposite the suction opening 71*c*.

Referring to FIG. 4, a pair of air connections 71*d*, 72*d* are provided for the respective tubes 71, 72 for intermittently supplying blowing air to each. The program for switching the blowing air on and off for the tubes 71, 72 is stored in the control unit 5.

The repair apparatus also includes a warp yarn store means within the housing 101 for holding a predetermined length of a fresh warp yarn as well a pneumatic tube 72' for conveying the fresh warp yarn from the store means into the first tube 71 for subsequent conveyance to the second tube 72.

As illustrated, the warp yarn store means includes a fresh warp yarn spool 10' from which fresh warp yarn 1 is drawn off into a tube 73' and introduced into the pneumatic tube 72'. the air connection in the pneumatic tube 72' is such as to blow the fresh warp yarn 1 into and between a pair of rollers 74 which grip and deliver the yarn to a yarn store 75 through which the yarn 1 runs horizontally until passing a sensor 91.

Upon initiation of picking of a weft thread (not shown), the sensor 91 delivers a signal to the control means S and starts up a counter which records the rotations of a drive motor 74' for the rollers 74. The rollers 74 then continue to run for a predetermined number of revolutions of the motor 74' or until a preset length of the fresh warp yarn 1 has been reached. Meanwhile, the tip of the warp yarn 1 has travelled through the store 75 into a splicer 76 which grips the tip of the yarn after a sensor 94 positioned to the right of the splicer 75, as viewed, has delivered a signal when the warp yarn passes by. During subsequent conveyance of the yarn through the rollers 74, a supply of the fresh warp yarn will form in the store 75.

The stored yarn is then maintained for use in a repair operation. After a repair operation is completed, the yarn store is replenished.

Referring to FIG. 1, a suction means 80 in the form of a suction tube 81 is provided to grip the end of the broken warp yarn 11 on the warp side. Initially, the suction nozzle 81 is in the same position as the folder blade 50 over the lane formed between the warp yarns 12, 13. The suction nozzle 81 pivots in the direction indicated by the arrow 81' towards a cutting and holding device 82 where the portion of the warp yarn 11 held by the suction nozzle 81 is deposited and cut in order to be connected to a fresh warp yarn 1 in a subsequent operation. As indicated in FIG. 5, the suction nozzle 81 lays the cut end of the broken yarn in the splicer 76 where the broken yarn end is joined to the tip of the fresh warp yarn 1. The end of the broken warp yarn 10' in the suction nozzle 81 can then be cut off by a cutter 79.

The end of the broken warp yarn 11 on the other side of the stop motion 2 is likewise gripped and pulled up by a suction means 80 in the form of a second suction nozzle 81. This is necessary to prevent the broken warp yarn 11 from becoming jammed on the front side of the holder blade 50 when the blade 50 is moved in the direction indicated by the arrow 50''.

In operation, after a broken yarn has been sensed in the stop motion 2, for example, by dropping of a wire 21 onto the rail 23, the two suction nozzles 81 grip the respective broken ends of the warp yarn and move the broken ends away from the stop motion 2. The folder blade 50 is then moved into the plane of the warp yarns penetrating into the lane defined by the now missing warp yarn. The folder blade 50 is then moved towards the heddle 31 into a position as shown in FIG. 4 so as to provide a free working space in the region of the heddles 30. A sensing means 55 on the blade 50 emits a signal to the control S so that the subsequent movement of the folder blade 50 is terminated at a position in which the heddle 31 occupies a groove in the blade 50.

Referring to FIG. 3, the tubes 71, 72 of the threading-in device 7 are initially positioned relative to the wire 21 of the stop motion device 2 for threading-in of the fresh warp yarn 1 into the opening of the wire 21. As indicated in FIG. 3*b*, the pneumatic tube 72' which receives the fresh warp yarn from the store 75 (see FIG. 1) is positioned to blow the fresh warp yarn 1 into the suction opening 71*c* of one tube 71. The yarn is then conveyed pneumatically along the tube 71 and blown from the blowing opening 71*a* through the opening of the wire 21 into the suction opening 72*c* of the second tube 72. The fresh warp yarn 1 is further blown along the length of the tube 72 into the position illustrated in FIG. 3*b*.

As indicated in FIG. 3, during the process of drawing in the fresh warp yarn 1 to the wire 21 of the stop motion 2, the folder blade 50 has penetrated into the warp plane by moving in the direction indicated by the arrow 50' and has formed a widened lane as indicated in FIG. 3*b*. FIG. 3*a* illustrates the movement when the folder blade 50 enters between the warp yarns 12, 13 adjacent the broken yarn 11. The stop motion wire 21 slopes in its bottom position 21' (shown in dotted line in FIG. 3) thus forming the lane for inserting the folder blade 50 between the neighboring warp yarns. The sloped position of the wire 21 can be obtained by means of angled slots in the contact rail 23 and by moving the contact rail 23 and a supporting rail 22 in the longitudinal direction relative to one another. A stop motion of this kind is described in Swiss Patent 169,657. In addition, a holder 24 is provided for gripping and lifting the wire 21 for the next drawing-in operation.

After threading in of the fresh warp yarn 1 into the wire 21 of the stop motion 2, the foremost tube 72 is positioned with the blowing opening 72*a* in alignment with the opening 32 in the heddle 31 as indicated in FIG. 4.

In order to draw the fresh warp yarn into the reed 4, the travelling tube 71 is moved forwardly into the dotted line position illustrated in FIG. 4. A guide 60 having an opening for passage of a warp yarn is pivoted through the reed 4 between the guide elements thereof into the position as shown in FIG. 5*c*. In this position, the guide 60 comes into registry with the tube 71 such that the opening therein is aligned with the blowing opening of the tube 71. Thereafter, air is blown into the tube 72 so as to blow the fresh warp yarn into the tube 71 in a manner as described above and thereafter through the opening in the guide 60. Thereafter, the guide 60 can be pivoted back through the reed 4 into the position on the opposite side of the reed 4 (FIG. 5*d*).

Referring to FIG. 1, the part of the broken warp yarn 11 in front of the heddles 31 of the heddle frame 3 can be gripped by a suction nozzle 81'' and drawn into the position 11''' near the reed 4. In this top position, the broken warp yarn end can easily be gripped by a further suction nozzle 83 as the yarn end is disposed above the warp yarns 12. The broken end can then be pulled forwardly over the woven fabric 100 by the suction nozzle 83.

As indicated in FIG. 4, the folder blade 50 is moved horizontally and vertically by the arm 56 in the direction indicated by the arrows while the threading-in tubes 71, 72 are moved horizontally by the arms 715, 725.

Referring to FIG. 4, at the end of the process of conveying and storing the fresh warp yarn 1, the rollers 74 stop and reverse their direction of movement as indicated by the arrow 74*b*. At the same time, air is blown into the auxiliary pneumatic tube 72' in the direction for conveying to the drawing-in tube 71.

At this time, a cutter 77 serves to cut the length of fresh warp yarn 1 to a predetermined length for subsequent insertion into a broken warp yarn.

As a result of the backward rotation of the rollers 74, the fresh warp yarn 1 is moved towards the tube 71 in a controlled manner via the tube 72' which is slotted along the entire length thereof as indicated in dotted line. The fresh warp yarn 1 is then, as described, blown into the stop motion wire 21 and then into the tube 72.

FIG. 5*a* shows parts of a front manipulator 101*a* which is mounted as viewed in FIG. 7*a* on a carriage 101' of the repair apparatus (hereinafter "the draw-in means" 101) in an operative position near the reed 4. A tracing element 101*c* with a transmitter L and a receiver E is positioned downstream of the reed 4 and moves immediately adjacent the reed 4 and closely above the warp yarns 12 in the top shed lengthwise of the reed 4 from the approximate position of the draw-in means 101 in alternate steps in both longitudinal directions, the reflected light beams of each individual warp yarn 12 triggering in the receiver E signals A1, A2 and so on. As shown in FIG. 5*b*, the signals define a sequence which the control 5 of the draw-in means 101 records. The step lengths of the longitudinal movement, can increase continuously until the position of the broken warp yarn 11 has been found.

The control S also monitors a drive 108 of the draw-in means 101, the latter drive being shown in FIGS. 7*a* and 7*b*. The pulses of the control S to the drive 108, which comprises, for example, a stepping motor, are associated with the received signals A1, A2 and so on. When the control S detects the absence of a signal between the signals A1 and A2, as shown in FIG. 5*b*, where all the other signals are at the same interval, the drive 108 is reversed by half that number of pulses which had previously been transmitted to the drive 108 between the receipt of the signals A1 and A2 to the drive 108. It may be necessary to move the shafts 3 alternately into the top shed a number of times during the hunting or searching operation until whichever shaft having the replacement yarn 1 drawn into its heddle 30 is in the top position. This occurs automatically in electronically controlled units for controlling the shafts.

The device then has the drawing-in element for the reed 4—i.e., the guide 60—exactly at the height of the replacement yarn 1 to be drawn into the reed 4 between two lamellae 40 in the set-value position and the guide 60 pivots through around the pivot 60*a* between the reed lamellae.

A force sensor 62 on the guide 60 in FIG. 5*a* ensures that the guide 60 or a reed lamella 40 is not damaged should the tip of the guide 60 not find the path between two reed lamellae 40. When a predetermined force in the guide 60 is exceeded, the force sensor 62 acts by way of the control 5 to stop the drawn-in means 101.

As hereinbefore described, the replacement yarn 1 is then threaded into the guide 60 and, as shown in FIG. 5*a*, drawn to the left through the reed 4. After the yarn 1 has been drawn through the reed 4, the manipulator 101*a* is moved further to the left over the cloth 100, the manipulator 101*a* possibly having to move round the temple 100*b* for the cloth as shown in FIG. 5*a* if the warp yarn 11 has broken at the edge of the cloth near the temple 100*b*. FIG. 5*d* shows the position of the replacement yarn 1*a* near the temple 100*b* or 1*b* in the zone outside the temple after the manipulator 101*a* has moved over the cloth 100.

Each of FIGS. 5*a*, 5*a* and 5*d* show a yarn clamp 27 and a shears blade 28 and in FIG. 5*d*, these elements are disposed above a cloth support 100*a*, the yarn clamp 27 pressing the replacement yarn 1 down on to the cloth 100. A suction nozzle 83 is disposed above the replacement yarn 1*c* for engaging the yarn 1*c* after the guide 60 has pivoted back into the top position (see FIG. 5*d*).

FIG. 6*a* shows the operating elements of the front manipulator 101*a* after the emergency yarn 1 has been drawn through the reed 4. The suction nozzle 83 has extracted the replacement yarn 1 and the yarn clamp 27, which is a plate-like element guided in contact with a shears blade 29, is moved downwardly towards the cloth 100 to the beating-up line A', the clamp 27 engaging the yarn 1 by way of a clamping edge 270*a*. The clamping edge 270*a* can be part of a resilient insert 270, thus ensuring very reliable retention of the emergency yarn 1.

On the side near the blade 28, the clamp 27 has a cutting edge 270*b* by way of which a cutting edge 280 of the blade 28 can be pushed when the clamp 27 is in a bottom position. The blade 28 can be pivotable, as will be apparent from position 28' of the blade 28 in FIG. 6*b*. The blade 28 is pivoted after being lowered into a vertical position in which the replacement yarn 1 can be severed.

FIG. 6*c* shows the yarn clamp 27 in a bottom position to retain the replacement yarn 1, the loom 102 having resumed operation and the replacement yarn 1 having been tied with a number of weft yarns. The replacement yarn 1 is also being retained by the nozzle 83. The replacement yarn 1 is then severed by the blade 28 with the cutting edge 280 being raised. The severed free end of the replacement yarn 1 is removed by the nozzle 83.

Conveniently, upon conclusion of the drawing-in step, the tracing element 101*c* makes a further check, by moving over the set-value position, that the replacement yarn has been drawn in correctly. If this is not the case, the control S can operate by way of a loom warning light to indicate to staff that manual intervention is necessary.

FIG. 7*a* is an overall view of the draw-in means 101 in an embodiment for conveyance above the loom. As indicated, the vehicle or carriage 101' has a drive 108 with a shaft 108*a* and at least one gear 108*b* for advancing the carriage 101', the same running on rails 105*a*, 105*b* with the interposition of running wheels 108*c*. A toothed rail 105*c* for advancing the carriage 101' extends along a rail 105*a*.

The front manipulator 101*a* and a rear manipulator 101*b*, in which latter the draw-in tubes 71, 72, the holder 24 for the stop motion wires and a blade-carrying arm 56 are carried, are each secured to and guided vertically relative to the carriage 101' by a column 103*a*, 103*b*. Drives 106*a*, 106*b* are adapted to move the columns 103*a*, 103*b* vertically. Further drives 107*a*, 107*b* are provided to move the brackets 104*a*, 104*b* on which the manipulators 101*a*, 101*b* are mounted to effect horizontal movements and for moving the discrete operating elements 71, 72, 24, 56, 60.

Also disposed in the draw-in means 101 are the control S and an air control means 109 comprising inter alia supply lines 109*a*, 109*b* for air at a positive pressure, air at a negative pressure, electricity and a receptacle 109*c* for extracted yarn residues. The loom 102 with the warp 10, whip roll 14, monitor wires 20 and heddles 30 is shown in diagrammatic form below the draw-in means 101. The rear manipulator 101*b* deals with the warp zone between the whip roll 14 and the heddles 30 and the front manipulator 101*a* with the zone between the cloth 100 and the reed 4.

Referring to FIG. 7*b*, wherein like reference characters indicate like parts as above, the carriage 101' may rest on the floor of a weaving shed with the interposition of rollers 108*c*. A nonconducting floor guidance system 110 moves the carriage through the weaving shed to whichever loom 102 requires a warp yarn repair. The control S communicates with the system 110. To harmonize the operations of the loom 102 and draw-in means 101, the carriage 101' has a transmitter and receiver 111 connected to the control S. The loom has a corresponding transmitter and receiver.

As indicated, the front manipulator 101*a* is mounted via a horizontal shaft 103*a* which can move horizontally relative to the carriage 101' via suitable means and has a bracket 104 capable of moving vertically via a suitable drive. Likewise, the rear manipulator 101*b* has a bracket 104*b* capable of moving horizontally and a shaft or beam 103*b* capable of moving vertically.

The invention thus provides a relatively simple apparatus and method for completely clearly broken warp yarns from a loom while completely replacing the broken warp yarn with a fresh warp yarn.

What is claimed is:

1. An apparatus for clearing a warp yarn break in a loom, said apparatus comprising a tracing element for moving across the width of a plurality of warp yarns downstream of a reed in the loom to detect an absence of a warp yarn, said tracing element having a transmitter for emitting a beam towards the warp yarns of the loom and a receiver for receiving a reflected beam from the warp yarns, said receiver emitting a signal in response to reception of the reflected beam to indicate the presence of a warp yarn;

a manipulator for moving across the width of the warp yarns to a position aligned with a detected gap in the warp yarns corresponding to an absent warp yarn; and a guide pivotally mounted on said manipulator for moving between a first position in said gap to receive a replacement warp yarn and a second position to draw the replacement warp yarn through said gap.

2. An apparatus as set forth in claim 1 wherein said transmitter emits a light beam.

3. An apparatus as set forth in claim 1 which further comprises a yarn clamp for holding a replacement warp yarn in a position for weaving in a cloth, said clamp being disposed in a position between said two positions of said guide.

4. An apparatus as set forth in claim 3 wherein said clamp has a cutting edge for the replacement warp yarn and which further comprises a shears blade movable along said clamp to sever a replacement warp yarn between said blade and said cutting edge.

5. An apparatus as set forth in claim 1 further comprising a carriage for movement over a loom, said carriage having said tracing element and said manipulator mounted thereon and drive means for moving each of said tracing element and said manipulator on said carriage relative to the warp yarns of the loom.

6. An apparatus as set forth in claim 5 which further comprises an air supply means on said carriage.

7. In combination, a loom having a plurality of shafts for passage of a plurality of warp yarns therethrough to define a shed and a reciprocally mounted reed for beating a weft yarn in said shed into an apex of said shed to form a cloth with the warp yarns;

a tracing element for moving across the width of said shed between said reed and said apex to detect a gap in said shed corresponding to a missing warp yarn;

a manipulator for moving across the width of said shed into alignment with said detected gap; and a guide pivotally mounted on said manipulator for movement between a first position extending through said reed to receive a replacement warp yarn and a second position spaced from said reed to draw the replacement warp yarn through said reed.

8. The combination as set forth in claim 7 wherein said tracing element has a transmitter for directing a beam onto the warp yarns of said shed and a receiver for receiving a reflected beam from the warp yarns and emitting a signal in response thereto.

9. The combination as set forth in claim 8 which further comprises a control for receiving said signals from said emitter in a predetermined pattern to detect said gap in said shed corresponding to the absence of the missing warp yarn, said control being connected to said manipulator to move said manipulator in response to said signals.

10. The combination as set forth in claim 7 further comprises a yarn clamp for holding a replacement warp yarn in a position for weaving in a cloth, said clamp being disposed in a position between said two positions of said guide.

11. The combination as set forth in claim 10 wherein said clamp has a cutting edge for the replacement warp yarn and which further comprises a shears blade movable along said clamp to sever a replacement warp yarn between said blade and said cutting edge.

12. The combination as set forth in claim 7 further comprising a carriage for movement over a loom, said carriage having said tracing element and said manipulator mounted thereon and drive means for moving each of said tracing element and said manipulator on said carriage relative to the warp yarns of the loom.

13. A method of clearing a warp yarn break in a loom comprising the steps of moving a tracing element across a shed of warp yarns between a reed and a cloth formed of the warp yarns to detect a gap in the shed corresponding to a broken yarn in the shed;

engaging and removing the broken warp yarn from said shed;

introducing a replacement warp yarn into the gap in the shed; and drawing the replacement warp yarn through the reed in the shed in a position corresponding to the detected gap.

14. A method as set forth in claim 13 which further comprises the steps of detecting the presence of each warp yarn in a top shed position of said shed and emitting a corresponding signal in response thereto during movement of the tracing element across the shed, comparing the emitted signals with a stored empirical sequence of signals, recording the position of the tracing element relative to said shed in response to the absence of a signal from the tracing element to establish the position of a gap in said shed corresponding to a broken yarn and thereafter moving a draw-in means into alignment with said gap in dependence on said recorded position for drawing the replacement warp yarn through the reed.

15. A method as set forth in claim 13 which comprises the step of initially moving the tracing element into the vicinity of a broken warp yarn in response to a signal from a warp yarn monitor for detecting warp yarn breaks and prior to movement of the tracing element to detect said gap.

16. A method as set forth in claim 13 which further includes the steps of moving the tracing element in alternating directions in increasing stepwise manner until detection of said gap.

17. A method as set forth in claim 16 which further includes the steps of moving the tracing element in one direction to obtain a first set value position for said gap, thereafter moving the tracing element in an opposite direction to obtain a second set value position for said gap and thereafter determining a mean set value position from said first and second set value position as an indication of said gap.

* * * * *